US009447527B2

(12) United States Patent
Jeon et al.

(10) Patent No.: US 9,447,527 B2
(45) Date of Patent: Sep. 20, 2016

(54) METHOD FOR MANUFACTURING HEAT RESISTANT SPUN YARN AND HEAT RESISTANT SPUN YARN MANUFACTURED THEREBY

(71) Applicants: Soo Hyun Jeon, Daegu (KR); Young Kyoo Park, Daegu (KR); JIGU Co., Ltd., Daegu (KR)

(72) Inventors: Soo Hyun Jeon, Daegu (KR); Young Kyoo Park, Daegu (KR)

(73) Assignees: Soo Hyun Jeon, Daegu (KR); Young Kyoo Park, Daegu (KR); JIGU CO., LTD., Daegu (KR)

( * ) Notice: Subject to any disclaimer, the term of this patent is extended or adjusted under 35 U.S.C. 154(b) by 275 days.

(21) Appl. No.: 14/072,424

(22) Filed: Nov. 5, 2013

(65) Prior Publication Data

US 2015/0107216 A1 Apr. 23, 2015

(30) Foreign Application Priority Data

Oct. 21, 2013 (KR) ..... 10-2013-0125568
Oct. 21, 2013 (KR) ..... 10-2013-0125588

(51) Int. Cl.

| | |
|---|---|
| ***D02G 3/44*** | (2006.01) |
| ***D02J 13/00*** | (2006.01) |
| ***D02G 1/02*** | (2006.01) |
| ***D02G 3/26*** | (2006.01) |

(52) U.S. Cl.

CPC ..... *D02G 3/443* (2013.01); *D02G 1/02* (2013.01); *D02G 3/26* (2013.01); *D02J 13/00* (2013.01)

(58) Field of Classification Search

CPC ..... D02G 3/26; D02G 3/28; D02G 3/443; D02G 1/02
USPC ..... 57/236, 237, 282
See application file for complete search history.

(56) References Cited

U.S. PATENT DOCUMENTS

| | | | | | |
|---|---|---|---|---|---|
| 2,253,048 | A * | 8/1941 | Quindry | A01K 91/00 | 43/44.98 |
| 3,365,768 | A * | 1/1968 | Brown | D02G 1/0286 | 28/155 |
| 3,431,814 | A * | 3/1969 | Boehm | D04C 1/00 | 87/2 |
| 4,877,073 | A * | 10/1989 | Thise | B60C 9/0042 | 152/451 |
| 5,442,903 | A * | 8/1995 | Lagarrigue | D02G 3/26 | 57/236 |
| 5,791,135 | A * | 8/1998 | Greenberg | D02G 1/02 | 28/285 |
| 6,782,686 | B2 * | 8/2004 | Mills | D02G 3/445 | 57/211 |
| 7,987,659 | B2 * | 8/2011 | Song | H05B 3/56 | 57/236 |
| 2004/0016221 | A1 | 1/2004 | Hatano et al. | | |
| 2005/0009430 | A1 * | 1/2005 | Tsung-Yueh | D02G 3/28 | 442/189 |

FOREIGN PATENT DOCUMENTS

| | | | |
|---|---|---|---|
| JP | 6-280120 | A | 10/1994 |
| JP | 9-59841 | A | 3/1997 |
| JP | 2003-13331 | A | 1/2003 |
| JP | 2005-9015 | A | 1/2005 |
| JP | 2007-100269 | A | 4/2007 |
| JP | 2008-190103 | A | 8/2008 |
| KR | 1997-0021399 | A | 5/1997 |
| KR | 10-0834329 | B1 | 6/2008 |

* cited by examiner

*Primary Examiner* — Shaun R Hurley
(74) *Attorney, Agent, or Firm* — Birch, Stewart, Kolasch & Birch, LLP

(57) ABSTRACT

A method for manufacturing a heat resistant spun yarn having improved elasticity which includes the steps of providing changes in twist amount, twist direction as well as low temperature heat treatment of ply yarn.

7 Claims, 21 Drawing Sheets

FIG. 17

TEST REPORT

APPLICANT : JIGU CO.,LTD
BUYER :

KATRI NO. : 0GAA13-00005247
DATE : OCT. 17. 2013.
PAGE(S) : 1 OF 1

APPLICANT'S PROVIDEO SAMPLE DESCAIPTION:
FOUR(4) KINDS OF SUBMITTED SAMPLE

S/No : # 1 -PBO:Para(40:60) Rip Stop. # 2 : PBO:Para(40:60)Rip Stop
3 -Meta 100% Rip Stop. #.4 : Meta 100% Rip Stop
RECEIVED DATE : OCT. 16. 2013. ***

FIG. 18

| TEST ITEM | TEST RESULTS | | | |
|---|---|---|---|---|
| | #1 | #2 | #3 | #4 |
| Breaking Strength (N/5cm) : KS K 0521:2011 C.A.E. Strip method | | | | |
| warp direction | 2800 | 2600 | 1800 | 1600 |
| weft direction | 3000 | 2800 | 1400 | 1500 |
| Elongation (%) : KS K 0352:2010.5.1.2 | | | | |
| warp direction | 8.5 | 1.8 | 7.9 | 1.7 |
| | #1 | #2 | #3 | #4 |

[sample 1]

[sample 1]

[sample 3]

[sample 3]

METHOD FOR MANUFACTURING HEAT RESISTANT SPUN YARN AND HEAT RESISTANT SPUN YARN MANUFACTURED THEREBY

TECHNICAL FIELD

The present invention relates to a technology for manufacturing a spun yarn, and more particularly, to a technology for manufacturing a heat resistant spun yarn having improved elasticity and a technology for manufacturing a heat resistant fabric having improved elasticity.

BACKGROUND ART

Typical thermoplastic synthetic fibers such as nylon or polyester fibers are melted at about 250° C. However, a decomposition temperature of heat resistant high performance fibers such as aramid fibers, wholly aromatic polyester fibers, and polyparaphenylene-benzobisoxazole fibers is high to be about 500° C.

The heat resistant high performance fibers have excellent heat resistant and flame retardancy, thus being extensively used in fire fighting garments, racer's suits, steel worker's clothes, and welder's clothes at high risk of exposure to flames and high temperatures. Further, the heat resistant high performance fibers may have heat resistance and high tenacity, thus being frequently used in athlete's uniforms, working clothes, ropes, tire cords, and others requiring high tear tenacity and heat resistance.

However, a yarn made of typical heat resistant high performance fibers has little elasticity, and fabrics made based on the fibers have little elasticity, too. Therefore, when clothes made of the heat resistant fiber-based fabrics were put on, the sense of wearing is not favorable, and there is a limit in activity required at exercise or work.

Accordingly, various studies have been conducted to provide elasticity to the yarns or the fabrics using the heat resistant fibers, and the resulting products are released. However, most of the current study results and released products are accompanied by deterioration in function of the heat resistant fibers due to heat treatment at high temperatures. Moreover, there are many cases that elasticity provided to the yarns or the fabrics using the heat resistant fibers is weak.

SUMMARY OF THE INVENTION

The present invention has been made in an effort to provide a technology for manufacturing a spun yarn having improved elasticity.

The present invention has been made in an effort to provide a technology for manufacturing a spun yarn having improved elasticity, in which intrinsic performance of a heat resistant fiber does not deteriorate, through low temperature heat treatment.

Embodiments of the present invention are not limited to those mentioned above, and other unmentioned embodiments of the present invention will be apparently understood by those skilled in the art to which the present invention belongs through the following description.

An exemplary embodiment of the present invention provides a method for manufacturing a heat resistant spun yarn, including a single yarn manufacturing process of twisting a heat resistant fiber in a first direction with a twist number in a predetermined range, a first heat setting process of applying heat at a first temperature in a predetermined range to a single yarn manufactured according to the single yarn manufacturing process, a ply yarn manufacturing process of combining at least two single yarns subjected to the first heat setting process and twisting the single yarns in the first direction with a first twist number in a predetermined range, a second heat setting process of applying heat at a second temperature in a predetermined range to a ply yarn manufactured according to the ply yarn manufacturing process, a reverse twisting process of twisting the ply yarn subjected to the second heat setting process in a second direction that is contrary to the first direction with a second twist number in a predetermined range, and a third heat setting process of applying heat at a third temperature in a predetermined range to the ply yarn subjected to the reverse twisting process.

The method may further include a re-twisting process of twisting the ply yarn subjected to the third heat setting process in the first direction with a third twist number in a predetermined range.

The second twist number may be larger than a sum total of the first twist number and the third twist number. In addition, the second temperature may be higher than the first temperature and the third temperature.

The heat resistant fiber may be an aramid fiber. Further, the heat resistant fiber may be a blend fiber including a first heat resistant fiber and a second heat resistant fiber. Further, the heat resistant fiber may be a blend fiber including the heat resistant fiber and a non-heat resistant fiber.

The first temperature, the second temperature, and the third temperature may be each a temperature of 50 to 100° C. In this case, the first temperature may be higher than the third temperature.

The heat setting process may not be performed after the re-twisting process.

Another exemplary embodiment of the present invention provides a method for manufacturing a heat resistant spun yarn having improved elasticity, including a single yarn manufacturing process of twisting a heat resistant fiber in a first direction with a twist number in a predetermined range, a ply yarn manufacturing process of combining at least two single yarns manufactured according to the single yarn manufacturing process and twisting the single yarns in the first direction with a first twist number in a predetermined range, a first heat setting process of applying heat at a first temperature in a predetermined range to a ply yarn manufactured according to the ply yarn manufacturing process, a reverse twisting process of twisting the ply yarn subjected to the first heat setting process in a second direction that is contrary to the first direction with a second twist number in a predetermined range, and a re-twisting process of twisting the ply yarn subjected to the reverse twisting process in the first direction with a third twist number in a predetermined range. In this case, the second twist number may be larger than a sum total of the first twist number and the third twist number.

The method may further include a second heat setting process of applying heat at a second temperature in a predetermined range to the single yarn manufactured according to the single yarn manufacturing process. In this case, the first temperature may be higher than the second temperature. In addition, the first temperature and the second temperature may be a temperature of 50 to 100° C.

The method may further include a third heat setting process of applying heat at a third temperature in a predetermined range to the ply yarn subjected to the reverse twisting process. In this case, the first temperature may be higher than the third temperature. In addition, the first temperature and the third temperature may be a temperature of 50 to 100° C.

The method may further include a second heat setting process of applying heat at a second temperature in a predetermined range to the single yarn manufactured according to the single yarn manufacturing process, and a third heat setting process of applying heat at a third temperature in a predetermined range to the ply yarn subjected to the reverse twisting process. The first temperature may be higher than the second temperature and the third temperature, and the second temperature may be higher than the third temperature. In addition, the first temperature, the second temperature, and the third temperature may be each a temperature of 50 to 100° C.

The heat resistant fiber may be a blend fiber including a first heat resistant fiber and a second heat resistant fiber. Further, the heat resistant fiber may be a blend fiber including the heat resistant fiber and a non-heat resistant fiber.

The heat setting process may not performed after the re-twisting process.

A heat resistant spun yarn having improved elasticity according to the present invention may be manufactured according to the aforementioned methods for manufacturing the heat resistant spun yarn.

A heat resistant fabric having improved elasticity according to the present invention may be manufactured using a heat resistant spun yarn manufactured according to the aforementioned methods for manufacturing the heat resistant spun yarn.

A heat resistant spun yarn and a heat resistant fabric manufactured according to the present invention can have improved elasticity as compared to a known heat resistant spun yarn.

Further, the spun yarn and the heat resistant fabric manufactured according to the present invention can have improved elasticity and provide intrinsic performance of a heat resistant fiber, which does not deteriorate, as compared to the known heat resistant spun yarn through low temperature heat treatment.

Further, according to the present invention, the heat resistant spun yarn and the heat resistant fabric having improved elasticity and sufficiently providing intrinsic performance of the heat resistant fiber can be manufactured even though known production equipment is used.

As described above, the present invention can solve serious problems in current heat resistant spun yarn and fabric manufacturing technology fields. The reason is because even though the heat resistant fiber such as an aramid fiber was developed and commercialized a long time ago, the heat resistant spun yarn and the heat resistant fabric having both intrinsic properties of the heat resistant fiber and elasticity have not been developed yet.

BRIEF DESCRIPTION OF THE DRAWINGS

FIG. 17 is a test report of the heat resistant fabrics manufactured according to the present invention.

FIG. 18 shows enlargement of only elongation test results of the test report shown in FIG. 17.

DETAILED DESCRIPTION

Figure 1:
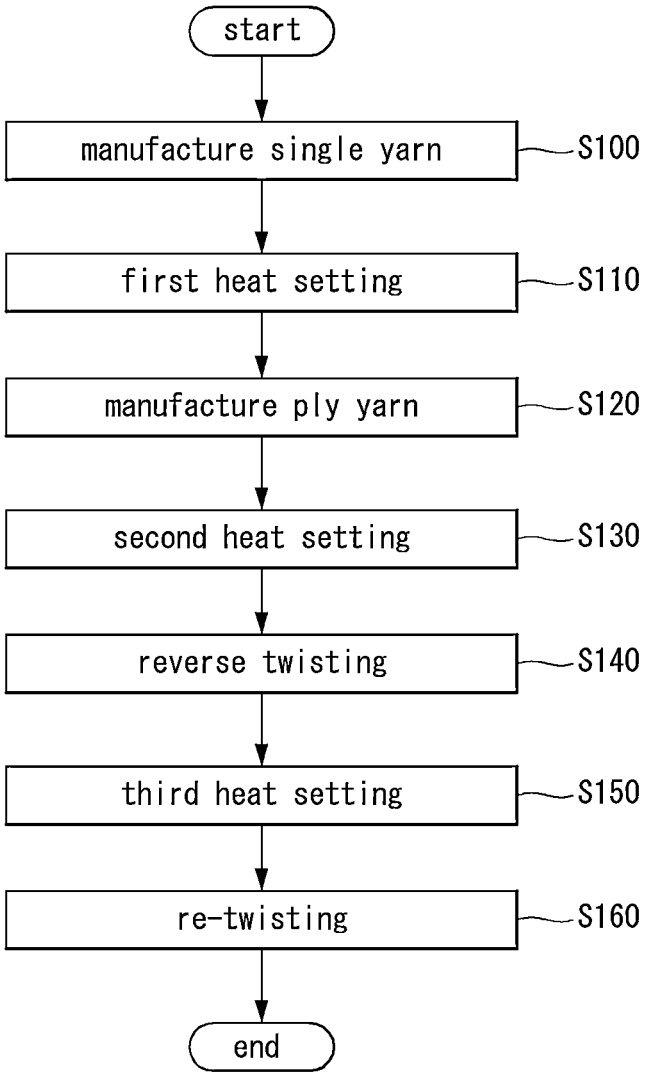
FIG. 1 is a flowchart showing an example of a method for manufacturing a heat resistant spun yarn according to the present invention.

Operational or functional advantages of the present invention, and the present invention achieved by embodiments will be sufficiently understood from the accompanying drawings exemplifying embodiments of the present invention and the detailed description taken in conjunction with the accompanying drawings.

Hereinafter, the application of the embodiments of the present invention is best understood with reference to the accompanying drawings. The same reference numerals shown in the drawings refer to the same elements.

FIG. 1 is a flowchart showing an example of a method for manufacturing a heat resistant spun yarn according to the present invention.

First, a heat resistant single yarn is manufactured using a heat resistant fiber S100. Herein, the heat resistant fiber may be an aramid fiber including a para-based polyamide fiber and a metha-based polyamide fiber, and may include a wholly aromatic polyester fiber and a polyparaphenylene-benzobisoxazole fiber. However, the scope of the present invention is not limited thereto.

Meanwhile, a heat resistant single yarn manufacturing process means that the heat resistant fiber is twisted in a first direction with a twist number in a predetermined number range. Herein, the first direction may be a clockwise direction or a counterclockwise direction based on a longitudinal direction axis of the heat resistant fiber. The single yarn manufacturing process will be described below in more detail with reference to FIGS. 2 and 3.

When the heat resistant single yarn is manufactured according to the single yarn manufacturing process, a first heat setting process of applying heat at a first temperature in a predetermined range to the manufactured single yarn is performed S110. Heat setting means that heat is applied so as to prevent the shape or the dimension of the fiber or fabric from being changed. In the step S110, heat setting means a process of applying heat at a predetermined temperature in order to increase stability of twist state of the single yarn. The heat setting process will be described below in more detail with reference to FIG. 4.

When first heat setting treatment of the single yarn is finished, a ply yarn manufacturing process of combining at least two single yarns subjected to the first heat setting treatment and twisting the single yarns in the first direction with a first twist number in a predetermined range is performed S120. Herein, the two twisted single yarns are called a 2 ply yarn, and the three twisted single yarns are called a 3 ply yarn. Meanwhile, it can be seen that the twist direction of the ply yarn is the same as the twist direction of the single yarn.

After the ply yarn process is performed, a second heat setting process of applying heat at a second temperature in a predetermined range to the manufactured ply yarn is performed. The second heat setting process may be performed by a method that is the same as or similar to the first heat setting. However, the second temperature may be higher than the first temperature. The reason is because the ply yarn has a larger thickness and higher resistance to solve twisting as compared to the single yarn. In addition, a second heat setting process time may be longer than a first heat setting time.

After the second heat setting process is performed, a reverse twisting process of twisting the ply yarn subjected to second heat setting treatment in a second direction that is contrary to the first direction with a second twist number in a predetermined range is performed S140. That is, the reverse twisting process means twisting of the ply yarn subjected to second heat setting in the second direction that is contrary to the first direction as the twist direction of the single yarn and the ply yarn.

Meanwhile, the twist number of the reverse twisting process may be larger than the twist number of the ply yarn manufacturing process. That is, when the reverse twisting process is performed, the twist direction of the ply yarn may be the second direction.

After the reverse twisting process is performed, a third heat setting process of applying heat at a third temperature in a predetermined range to the manufactured ply yarn is performed S150. The third heat setting process may be performed by a method that is the same as or similar to the first heat setting. The ply yarn may have elasticity due to a property in which a twisting state is maintained in the first direction according to the second heat setting process and a property in which a reverse twisting state is maintained in accordance with performing of the third heat setting process.

Meanwhile, the third temperature may be lower than the first temperature and the second temperature corresponding to those of the heat setting processes performed after the single yarn manufacturing process and the ply yarn manufacturing process. In addition, a third heat setting time may be shorter than the first heat setting time and a second heat setting time.

Further, all of the first to third temperatures may be a temperature of 50 to 100° C. In consideration of a heat setting temperature of the heat resistant fiber such as the aramid fiber, which is almost 200° C. or more, the heat setting process performed in the method for manufacturing the heat resistant spun yarn according to the present invention may be a low temperature heat treatment process. Therefore, the degree of deterioration of the heat resistant fiber according to the method for manufacturing the heat resistant spun yarn according to the present invention may be much lower than the degree of deterioration of the heat resistant fiber according to a known method.

After the third heat setting process is performed, a re-twisting process of twisting the ply yarn subjected to third heat setting treatment in the first direction with a third twist number in a predetermined range is performed S160. Herein, a sum total of the third twist number of the reverse twisting process and the first twist number of the ply yarn manufacturing process may be smaller than the second twist number of the reverse twisting process. That is, as a result of performing up to the re-twisting process, a final twist direction of the manufactured heat resistant spun yarn may be the second direction. The re-twisting is performed to provide again a property of returning back to a state after second heat setting.

After the re-twisting process S160, a separate heat setting process may not be performed. The reason is because a twist property of the ply yarn may be almost stabilized according to the first and third heat setting processes. Meanwhile, according to another embodiment of the present invention, an additional heat setting process may be performed at very low temperatures after the re-twisting process is performed. This may be performed to further stabilize the twist property of the re-twisted ply yarn.

Meanwhile, unlike FIG. 1, the first to third heat setting processes may be an optional process. For example, according to another embodiment of the present invention, only any one of the first to third heat setting processes may be performed, or only two heat setting processes may be performed.

Further, unlike FIG. 1, the reverse twisting or re-twisting process performed after the second heat setting process may be an optional process. For example, in another embodiment of the present invention, only any one process of the reverse twisting process and the re-twisting process may be performed, or both the two processes may not be performed.

A relationship from the ply yarn manufacturing process of the step S120 to the re-twisting process of the step S160 will be described below in more detail with reference to FIGS. 5 and 6.

Figure 2:
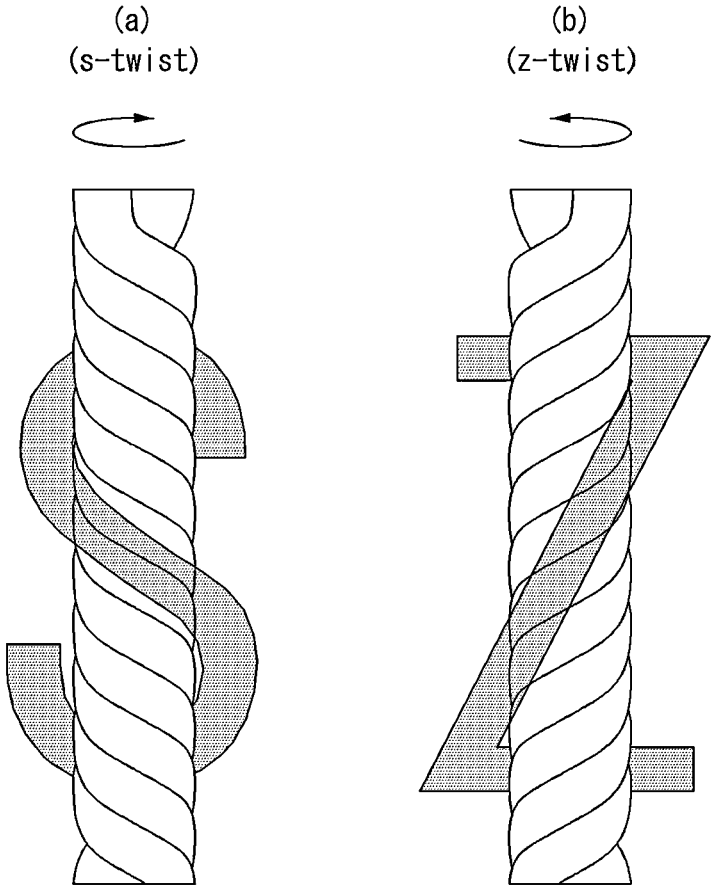
FIG. 2 shows examples in which a single yarn is manufactured according to the method for manufacturing the heat resistant spun yarn shown in FIG. 1.

FIG. 2 shows examples in which the single yarn is manufactured according to the method for manufacturing the heat resistant spun yarn shown in FIG. 1.

FIG. 2(*a*) shows that the heat resistant fiber is twisted in a clockwise direction based on a longitudinal direction axis. This twist is called a s-twist, and a yarn to which this twist is applied is called a s-twisted yarn.

FIG. 2(*b*) shows that the heat resistant fiber is twisted in a counterclockwise direction based on the longitudinal direction axis. This twist is called a z-twist, and a yarn to which this twist is applied is called a z-twisted yarn.

In the method for manufacturing the heat resistant spun yarn according to the present invention, when the twist direction of the single yarn manufacturing process, the ply yarn manufacturing process, and the re-twisting process is any one of a s-twist direction and a z-twist direction, the twist direction of the reverse twisting process may be the other one of the s-twist direction and the z-twist direction. However, the final twist direction of the heat resistant spun yarn manufactured according to the method for manufacturing the heat resistant spun yarn is determined by a difference between a sum total of the twist number of the ply yarn manufacturing process and the twist number of the re-twisting process and the twist number of the reverse twisting process.

Figure 3:
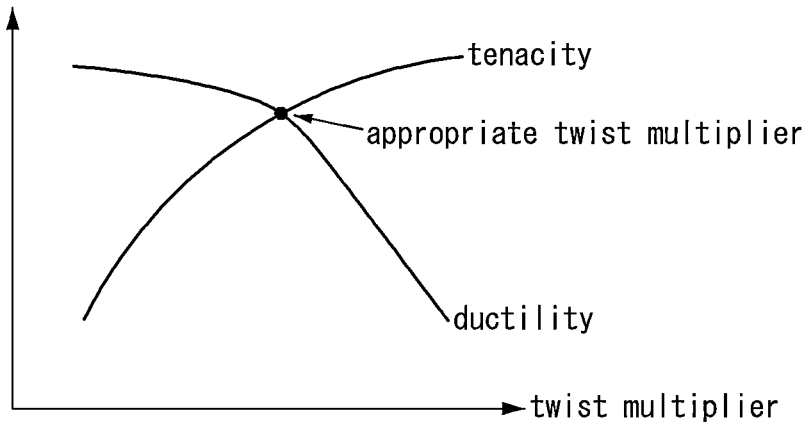
FIG. 3 is a graph showing a method for determining an appropriate twist multiplier of the single yarn or a ply yarn according to the method for manufacturing the heat resistant spun yarn shown in FIG. 1.

FIG. 3 is a graph showing a method for determining an appropriate twist multiplier of the single yarn or the ply yarn according to the method for manufacturing the heat resistant spun yarn shown in FIG. 1.

The twist multiplier means a constant determined by the thickness and the twist number of the yarn. Referring to the graph of FIG. 3, it can be seen that tenacity of the yarn is increased but ductility of the yarn is gradually reduced as the twist multiplier is increased. According to the method for manufacturing the heat resistant spun yarn according to the present invention, the appropriate twit multiplier of the single yarn or the ply yarn may be determined by a twist multiplier at which a tenacity curve and an ductility curve according to the twist multiplier meet each other. When the twist multiplier is determined, the twist number according to the thickness of the yarn may be determined. Therefore, the graph may be used to determine the twist number of the single yarn or the ply yarn in the method for manufacturing the heat resistant spun yarn according to the present invention.

Meanwhile, ductility of the yarn means the degree of elongation when the yarn is drawn by constant force, and the tenacity of the yarn means the degree of toughness to breakage of the yarn.

Figure 4:
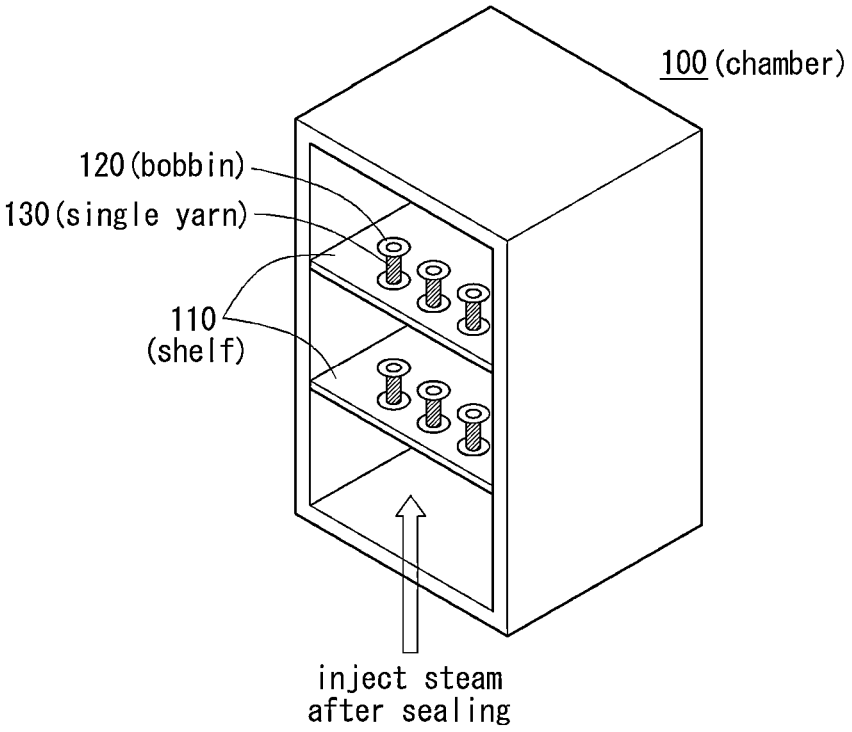
FIG. 4 is a view showing a method for performing a heat setting process according to the method for manufacturing the heat resistant spun yarn shown in FIG. 1.

FIG. 4 is a view showing a method for performing the heat setting process according to the method for manufacturing the heat resistant spun yarn shown in FIG. 1.

Referring to FIG. 4, the first heat setting process of the single yarn in the method for manufacturing the heat resistant spun yarn shown in FIG. 2 may be performed by providing a single yarn 130 onto a shelf 110 of a predetermined chamber 100 while the single yarn 130 is wound around a bobbin 120, sealing the chamber 100, and supplying steam at a predetermined temperature to the chamber 100 for a predetermined time in that state.

However, the first heat setting process in the method for manufacturing the spun yarn according to the present invention is not performed only by the aforementioned procedure. For example, the first heat setting process may be performed by a process of immersing the manufactured single yarn in water at a predetermined temperature for a predetermined time, or applying infrared rays at a predetermined temperature to the manufactured single yarn for a predetermined time.

Figure 5:
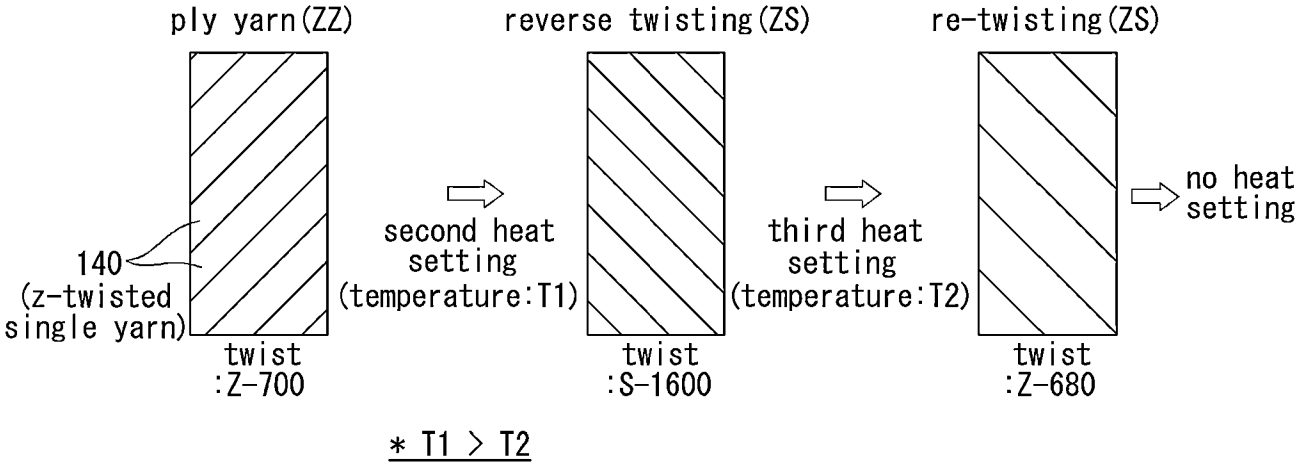
FIG. 5 shows an example of a ply yarn manufacturing process to a re-twisting process performed according to the method for manufacturing the heat resistant spun yarn shown in FIG. 1.

FIG. 5 shows an example of the ply yarn manufacturing process S120 to the re-twisting process S160 performed according to the method for manufacturing the heat resistant spun yarn shown in FIG. 1.

In the example shown in FIG. 5, the ply yarn may be manufactured by the z-twist to the two z-twisted single yarns. The front z of zz representing a twist type of the ply yarn represents the twist direction of the single yarn, and the rear z represents the twist direction of the ply yarn.

After the second heat setting process of the ply yarn is performed, the reverse twisting process is performed. Performing of reverse twisting results in a zs type of the ply yarn as the twist type. This is because a s-direction twist number of 1600 in the reverse twisting process is larger than a z-direction twist number of 720 according to the ply yarn process. Performing of the reverse twisting process results in the twist number of the ply yarn of 980 in a s-direction.

After reverse twisting is performed, the third heat setting process is performed. A temperature T2 corresponding to the third heat setting process may be lower than a temperature T1 corresponding to second heat setting. After the third heat setting process is performed, the re-twisting process is performed. Even after the re-twisting process is performed, the twist type of the ply yarn is maintained as the zs type. This is because the s-direction twist number of 980 after the reverse twisting process is performed is larger than the z-direction twist number of 680 in the re-twisting process. Referring to FIG. 5, it can be seen that the s-direction twist number of the ply yarn subjected to the reverse twisting process is reduced after the re-twisting process is performed.

Meanwhile, according to another embodiment of the present invention, the z-direction twist number of the re-twisting process may be larger than 980. In this case, the final twist type of the ply yarn may be a zz type.

After the re-twisting process is performed, a separate heat setting process may not be performed. This is because the twist property of the ply yarn may be already stabilized to a certain degree.

Meanwhile, in the example shown in FIG. 5, it is preferable that the second heat setting process and the third heat setting process be performed at 100° C. or less. As described above, this is performed to minimize the degree of deterioration of the heat resistant fiber by low temperature heat treatment.

Further, the second heat setting process and the third heat setting process may be an optional process. For example, in another embodiment of the present invention, only one of the second heat setting process and the third heat setting process may be performed, or both the two processes may be omitted.

Figure 6:
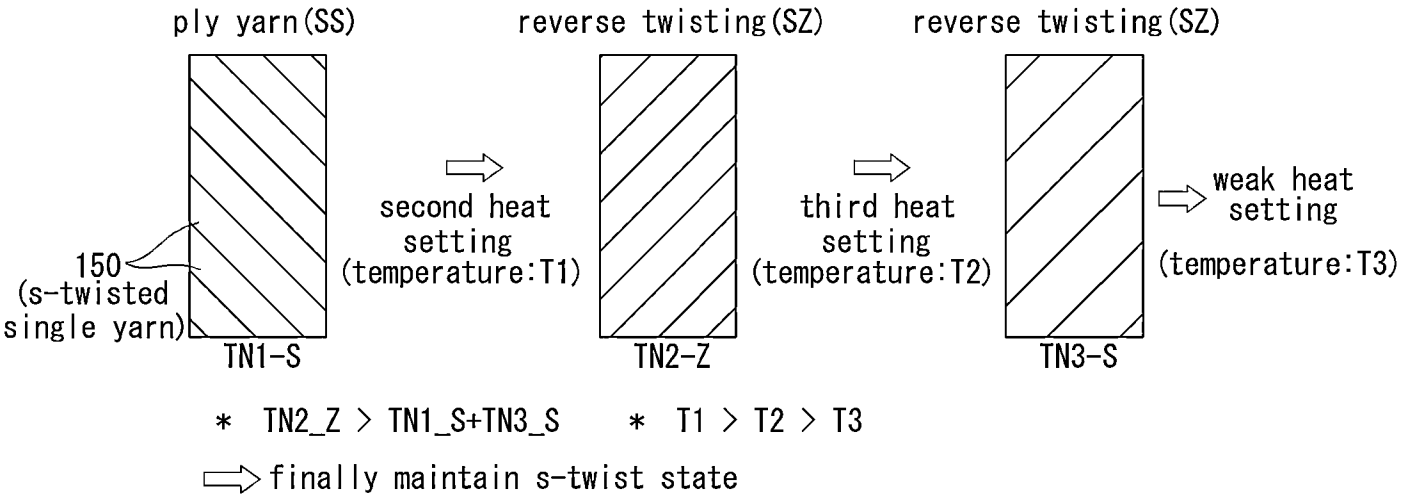
FIG. 6 shows an example of a ply yarn manufacturing process S120 to a re-twisting process performed according to the method for manufacturing the heat resistant spun yarn shown in FIG. 1.

FIG. 6 shows an example of the ply yarn manufacturing process S120 to the re-twisting process S160 performed according to the method for manufacturing the heat resistant spun yarn shown in FIG. 1.

In the example shown in FIG. 6, the twist directions of the single yarn and the ply yarn are contrary to those of the example shown in FIG. 5, and the twist directions of the reverse twisting process and the re-twisting process are contrary to those of the example shown in FIG. 5. Those skilled in the art will easily understand and deduct the example shown in FIG. 6 with reference to the example shown in FIG. 5, with the exception of the aforementioned contents. Accordingly, only a difference between both will be briefly described.

In the example shown in FIG. 6, the final twist type of the ply yarn may be a sz type. This is because a sum total of a s-direction twist number TN1_S of the ply yarn process and a s-direction twist number TN3_S of the re-twisting process is smaller than a z-direction twist number TN2_Z in reverse twisting. Meanwhile, like in FIG. 5, the final twist type of the ply yarn may be a ss type.

Further, in the example shown in FIG. 6, a separate weak heat setting process may be performed after the re-twisting process is performed. Herein, a temperature T3 of weak heat setting may be lower than the temperature T1 of second heat setting performed in advance and the temperature T2 of third heat setting performed in advance.

Figure 7:
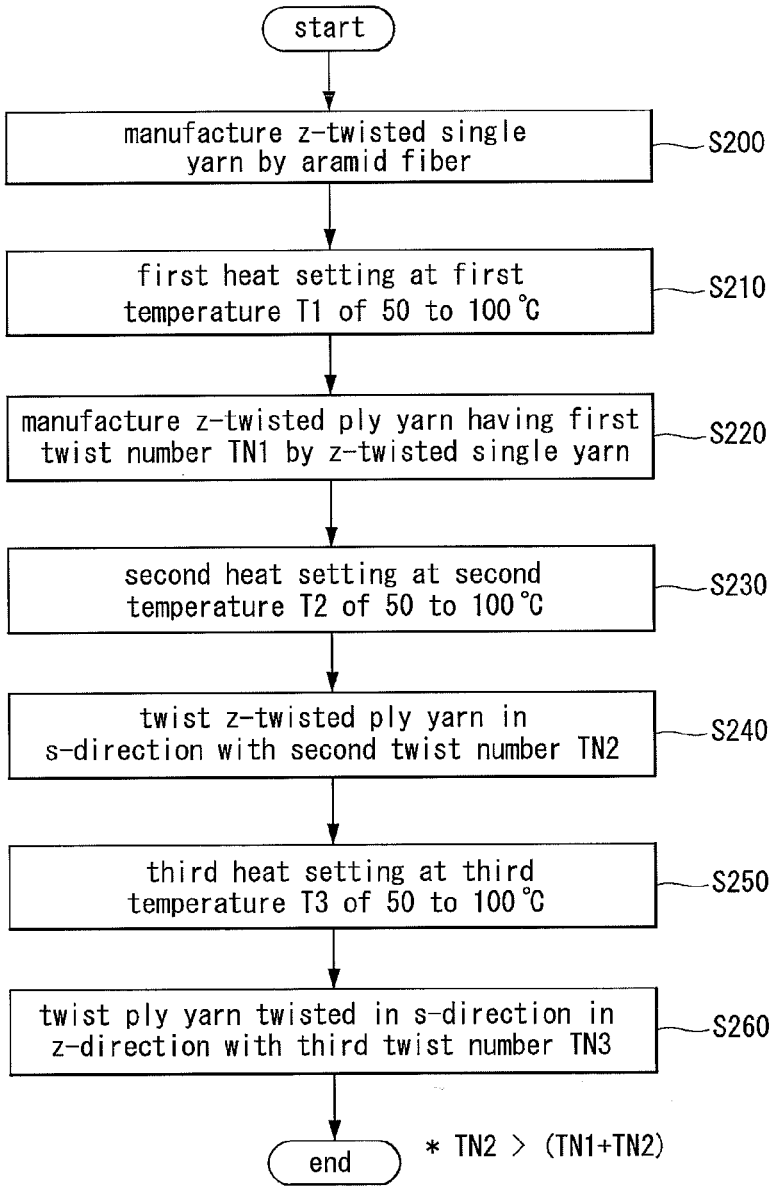
FIG. 7 is a flowchart showing an example of the method for manufacturing the heat resistant spun yarn according to the present invention shown in FIG. 1.

FIG. 7 is a flowchart showing an example of the method for manufacturing the heat resistant spun yarn according to the present invention shown in FIG. 1.

First, a z-twisted single yarn (that is, z-twisted aramid single yarn) is manufactured by using an aramid fiber as a representative example of the heat resistant fiber S200. That is, in the method for manufacturing the heat resistant spun yarn shown in FIG. 1, the first direction is a z-direction.

Next, a first heat setting process is performed at a first temperature T1 of 50 to 100° C. over the manufactured single yarn S210. However, a heat setting temperature is not limited to the aforementioned range. The same is applicable to second and third heat setting processes as will be described later.

A z-twisted ply yarn (that is, z-twisted aramid ply yarn) having a first twist number TN1 is manufactured by using the z-twisted single yarn S220. Next, a second heat setting process is performed at a second temperature T2 of 50 to 100° C. over the z-twisted ply yarn S230.

In addition, a reverse twisting process of twisting the z-twisted ply yarn subjected to second heat setting treatment in a s-direction with a second twist number TN2 is performed S240. That is, in the method for manufacturing the heat resistant spun yarn shown in FIG. 1, the second direction is a s-direction. Herein, the second twist number TN2 may be larger than the first twist number TN1. As a result, the ply yarn becomes a s-twisted ply yarn (that is, s-twisted aramid ply yarn).

A third heat setting process is performed at a third temperature T3 of 50 to 100° C. over the ply yarn twisted in the s-direction by performing the reverse twisting process S250. Next, a re-twisting process of twisting the ply yarn twisted in the s-direction again with a third twist number TN3 in the z-direction is performed S260. Meanwhile, the second twist number TN2 may be larger than a sum total of the first twist number TN1 and the third twist number TN3. Accordingly, the final twist type of the ply yarn may be a zs type.

As described above, a separate heat setting process may not be further performed after the re-twisting process. Further, a weak heat setting process may be further performed.

Further, like the aforementioned examples, the second temperature may be higher than the first temperature and the third temperature. In addition, a second heat setting time may be longer than a first heat setting time and a third heat setting time. Further, the first heat setting time may be longer than the third heat setting time.

Further, like the aforementioned examples, the first to third heat setting processes may be an optional process. For example, in the method for manufacturing the heat resistant spun yarn according to another embodiment of the present invention, only any one of the first to third heat setting processes may be optionally performed, or the two heat setting processes may be optionally performed.

All processes of the method for manufacturing the heat resistant spun yarn are performed at a temperature of 100° C. or less. That is, as compared to a known technology, the method for manufacturing the spun yarn according to the present invention is performed at relatively low temperatures. This is an epoch-making technology not attempted in a known technology for manufacturing a heat resistant spun yarn, in which high temperature treatment is essential or may be performed in the process of manufacturing the spun yarn using the heat resistant fiber.

The degree of deterioration of intrinsic heat resistance or physical tenacity of the heat resistant fiber in the spun yarn according to the present invention manufactured at low temperatures is understandably smaller than that of the spun yarn manufactured by a known technology. Moreover, the spun yarn according to the present invention has improved elasticity based on a twist direction control, a twist number control according to a twist direction, and low temperature heat setting according to the twist direction as compared to the heat resistant spun yarn manufactured by the known technology.

Figure 8:
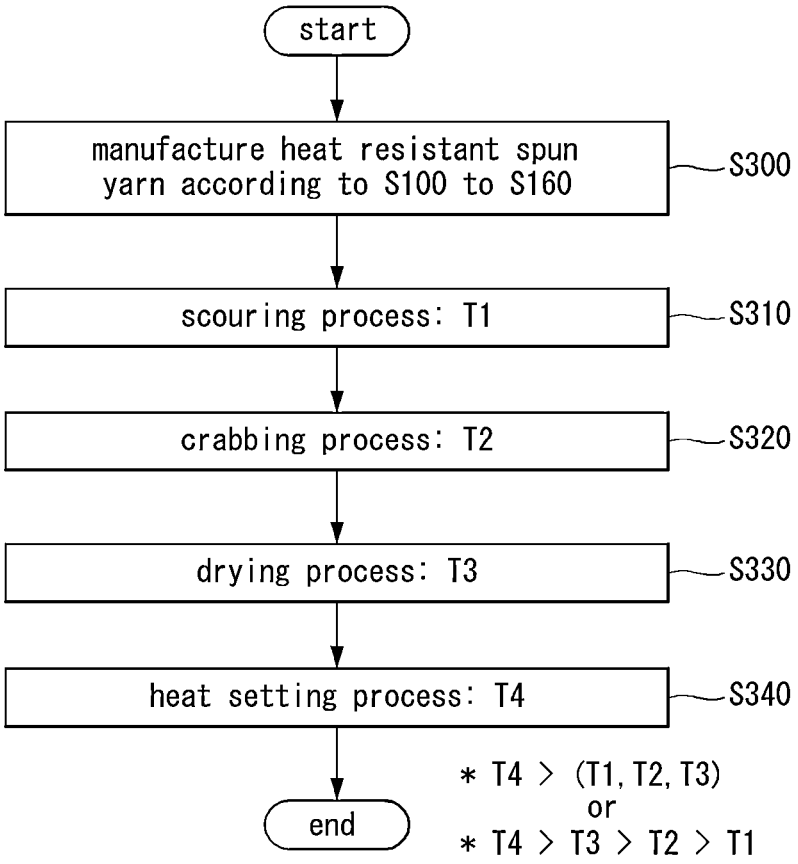
FIG. 8 is a flowchart showing an example of a method for manufacturing a heat resistant fabric according to the present invention.

FIG. 8 is a flowchart showing an example of a method for manufacturing a heat resistant fabric according to the present invention. Hereinafter, the method for manufacturing the heat resistant fabric will be described with reference to the required drawings.

The heat resistant spun yarn is manufactured according to the steps S100 to S160 shown in FIG. 1 S300. To be more specific, manufacturing of the step S300 may be performed according to the method for manufacturing the heat resistant spun yarn shown in FIG. 7.

When the heat resistant spun yarn is manufactured, a scouring process is performed S310. Herein, the scouring process may be a process of washing the heat resistant fabric by water at a first temperature in a predetermined range while passing the heat resistant fabric between a first roller and a second roller. The first temperature may be a temperature of 20 to 90° C. More preferably, the first temperature may be a temperature of 30 to 40° C.

Figure 9:
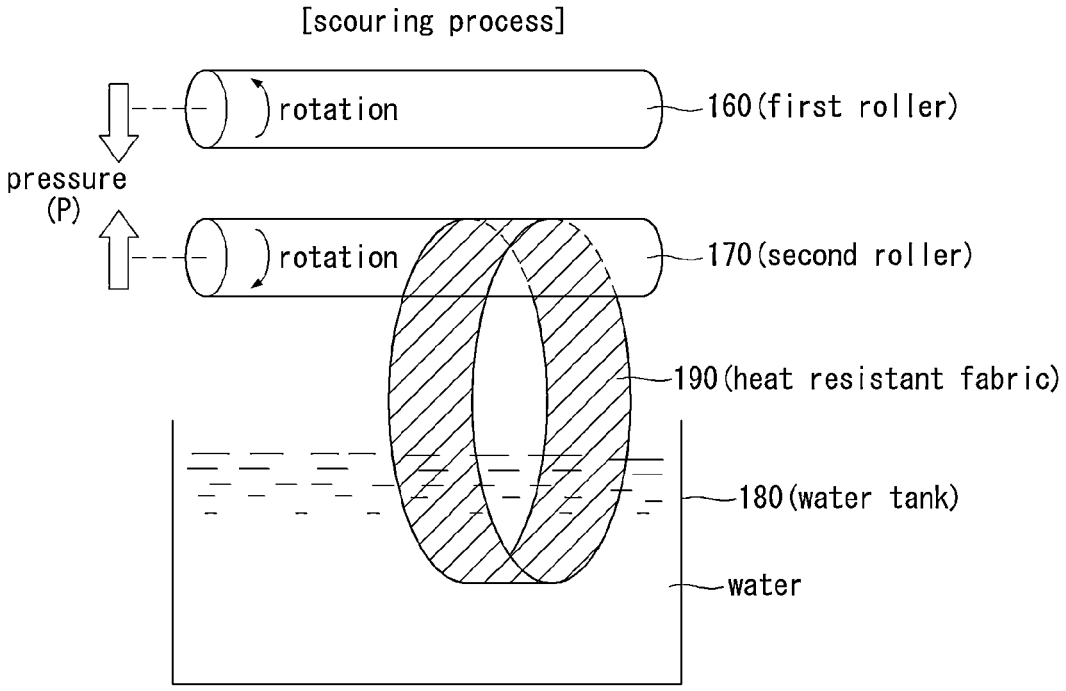
FIG. 9 is a view showing a scouring process performed in the method for manufacturing the heat resistant fabric shown in FIG. 8.

FIG. 9 is a view showing a scouring process S310 performed in the method for manufacturing the heat resistant fabric shown in FIG. 8.

The scouring process may include a plurality of washing processes of washing a heat resistant fabric 190 by water at the first temperature at a plurality of pressure levels while increasing pressure applied between a first roller 160 and a second roller 170 stage by stage.

In this case, each of a plurality of washing processes may include a first scouring process of washing the heat resistant fabric by water including a washing component for a predetermined time, and a second washing process of washing the heat resistant fabric treated by the first scouring process by water not including the washing component. The time for which the first scouring process is performed may depend on each pressure level. The same is applicable to the time for which the second scouring process is performed.

A more specific example of the scouring process will be described.

Figure 10:
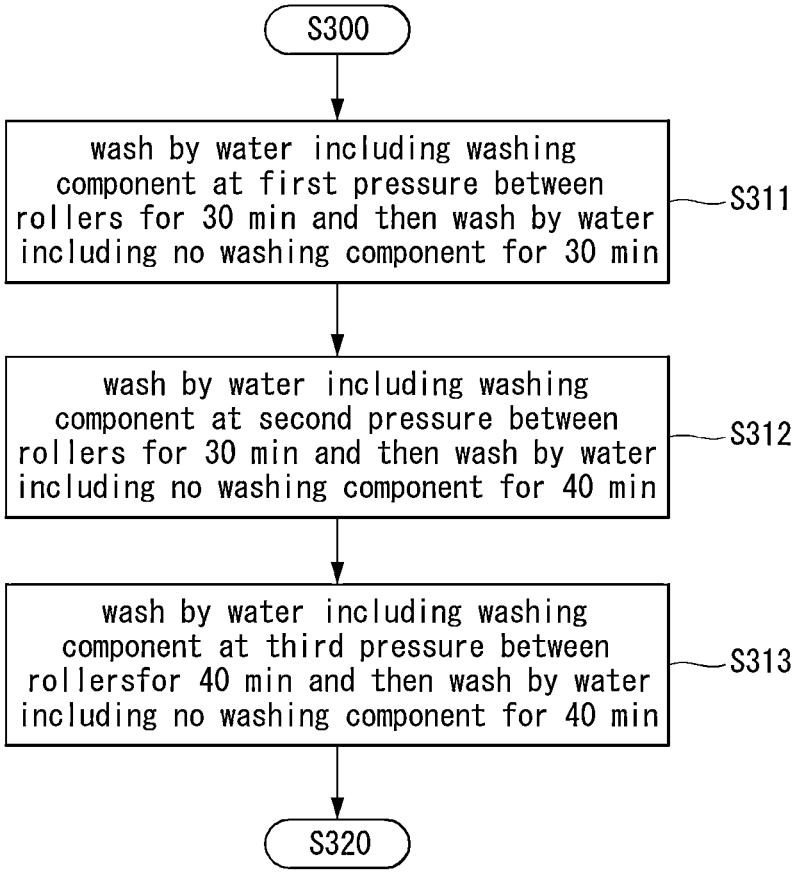
FIG. 10 shows an example of the scouring process performed in the method for manufacturing the heat resistant fabric shown in FIG. 8.

FIG. 10 shows an example of the scouring process performed in the method for manufacturing the heat resistant fabric shown in FIG. 8.

First, the heat resistant fabric 190 is washed by water including the washing component contained in a water tank 180 at 30° C. for 30 min while passing through the first roller 160 and the second roller 170 to which first pressure (for example, pressure corresponding to a weight of 2000 kg) is applied. Next, the heat resistant fabric is washed by water including no washing component at 30° C. for 30 min while passing through the first roller 160 and the second roller 170 to which pressure of 2 k is applied S311.

Next, the heat resistant fabric 190 is washed by water including the washing component contained in the water tank 180 at 30° C. for 30 min while passing through the first roller 160 and the second roller 170 to which second pressure (for example, pressure corresponding to a weight of 3000 kg) is applied. Next, the heat resistant fabric is washed by water including no washing component at 30° C. for 40 min while passing through the first roller 160 and the second roller 170 to which pressure of 3 k is applied S312.

Next, the heat resistant fabric 190 is washed by water including the washing component contained in the water tank 180 at 30° C. for 40 min while passing through the first roller 160 and the second roller 170 to which third pressure (for example, pressure corresponding to a weight of 4,000 kg) is applied. Next, the heat resistant fabric is washed by water including no washing component at 40° C. for 40 min while passing through the first roller 160 and the second roller 170 to which pressure of 3 k is applied S313. Performing of the scouring process may be finished through the aforementioned process.

Unlike a process of manufacturing fabrics using typical chemical fibers or synthetic fibers, in which a singeing process or a heat treatment process is performed in advance, in the method for manufacturing the heat resistant fabric according to the present invention, the scouring process of the manufactured fabric is directly performed.

Turning to FIG. 8, when the scouring process is finished, a crabbing process of applying heat at a second temperature to the heat resistant fabric subjected to scouring treatment, and winding the heat resistant fabric around a third roller is performed S320. Herein, the heat resistant fabric heat-treated at the second temperature may be wound around the third roller together with a high density fabric heat-treated at the second temperature. Meanwhile, the high density fabric may have a dense and smooth surface as compared to the heat resistant fabric.

A tissue of the heat resistant fabric may be stabilized, the sense of elasticity may be provided to the heat resistant fabric, and the surface of the heat resistant fabric may be further made smooth by the crabbing process. Meanwhile, the second temperature at which the crabbing process is performed may be a temperature of 20 to 90° C. More preferably, the second temperature may be a temperature of 70 to 80° C. That is, a crabbing temperature may be higher than a scouring temperature.

Figure 11:
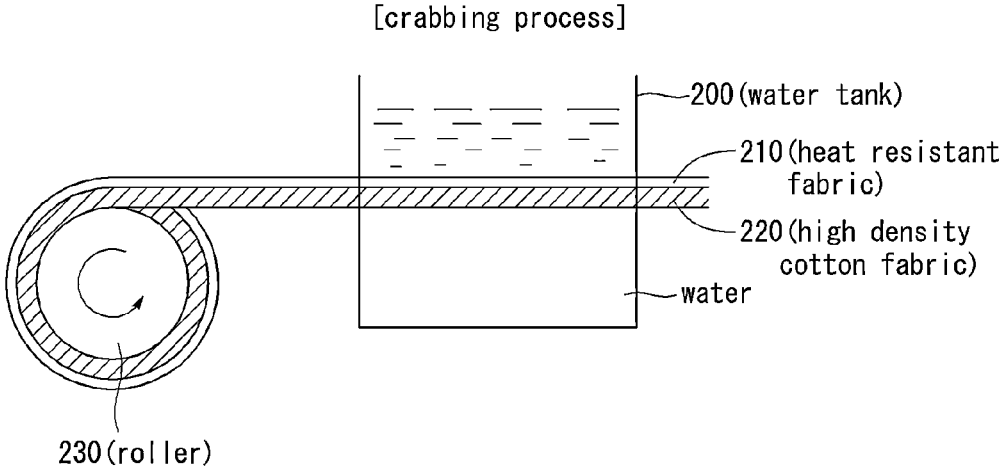
FIG. 11 is a view showing a crabbing process performed in the method for manufacturing the heat resistant fabric shown in FIG. 8.

FIG. 11 is a view showing the crabbing process performed in the method for manufacturing the heat resistant fabric shown in FIG. 8.

Referring to FIG. 11, predetermined heat is applied to a heat resistant fabric 210 and a high density cotton fabric 220 by water contained in the water tank 200 at a temperature in a predetermined range. Heat may be applied to the heat resistant fabric 210 and the high density cotton fabric 220 by steam or infrared rays other than water.

After predetermined heat is applied, the heat resistant fabric 210 and the high density cotton fabric 220 are wound together around a third roller 230. The surface of the heat resistant fabric may be further made smooth and elasticity may be added based on drawing applied when winding is performed and contact of the heat resistant fabric with the surface of the high density cotton fabric.

Turning to FIG. 8, when the crabbing process is finished, a drying process of drying the heat resistant fabric subjected to crabbing treatment at a third temperature in a predetermined range is performed S330. The third temperature may be a temperature of 20 to 90° C. However, the third temperature may be a temperature that is lower than the second temperature.

Meanwhile, as compared to a typical process of drying the heat resistant fabric such as the aramid fabric at about 150° C., the drying process of the method for manufacturing the heat resistant fabric according to the present invention may be a low temperature drying process. Further, the washing process and the crabbing process as described above are performed at a low temperature of 100° C. or less. Therefore, in the method for manufacturing the heat resistant fabric according to the present invention, deterioration of the heat resistant fiber due to heat may be very small as compared to a known method.

When drying treatment is finished, a heat setting process of applying heat at a fourth temperature to the heat resistant fabric subjected to the drying treatment is performed S340. The heat setting process is a process of finally setting a state of the heat resistant fabric. The fourth temperature may be a temperature of 90 to 200° C. That is, the fourth temperature may be higher than the first to fourth temperatures. Preferably, the fourth temperature may be a temperature of 130 to 200° C. That is, in the method for manufacturing the heat resistant fabric according to the present invention, the drying process is only one process performed at a temperature of 100° C. or more.

In the method for manufacturing the heat resistant spun yarn, there is no process treated at a temperature of more than 100° C. In the present method for manufacturing the heat resistant fabric, a treatment temperature of all processes other than the drying process does not exceed 100° C.

This is an epoch-making technology not attempted in a known technology for manufacturing a heat resistant spun yarn or a known method for manufacturing a heat resistant fabric, in which high temperature treatment is essential or may be performed in the process of manufacturing the spun yarn or the fabric using the heat resistant fiber.

That is, the degree of deterioration of intrinsic heat resistance or physical tenacity of the heat resistant fiber in the heat resistant fabric according to the present invention manufactured at low temperatures is understandably smaller than that of the heat resistant fabric manufactured by the known technology. Moreover, the heat resistant fabric according to the present invention has improved elasticity based on improved elasticity of the heat resistant spun yarn forming the fabric as compared to the heat resistant fabric manufactured by the known technology.

The following Table 1 is an example showing the degree of improvement of elasticity of the fabric manufactured using the heat resistant spun yarn manufactured by the method for manufacturing the heat resistant spun yarn according to the present invention. For reference, the following data are obtained by asking FITI Testing & Research Institute in Korea to perform a test.

TABLE 1

| | | Twist | | | | |
|---|---|---|---|---|---|---|
| | Yarn number | Single yarn | First ply yarn | Second ply yarn | Elastic modulus (%) | Bulkiness |
| Example 1 | 68 | 750_z | 630_z | 670_s | 8.59 | ○ |
| Example 2 | 52 | 750_z | 630_z | 670_s | 9.82 | ○ |

According to Example 1, when an aramid single yarn having a twist number of 750 in a z-direction is manufactured based on an aramid fiber having a yarn number of 68 is manufactured, the manufactured two single yarns are twisted in the z-direction 630 times to manufacture a 2 ply yarn, and a s-twisted ply yarn having a twist number of 670 is finally manufactured to manufacture a heat resistant fabric based thereon, it can be seen that elastic modulus of the manufactured fabric is 8.89%. Further, it can be seen that elastic modulus of a heat resistant fabric according to Example 2 manufactured by the same process, except that the yarn number is 52 different from that of Example 1, is 9.82%. The elastic moduli may be considered to be very high as elastic modulus of the heat resistant fabric manufactured based on the aramid fiber.

Moreover, it can be seen that the heat resistant fabrics according to Examples 1 and 2 have favorable bulkiness.

In consideration of the aforementioned data, the present invention can solve serious problems in current heat resistant spun yarn and fabric manufacturing technology fields. The reason is because even though the heat resistant fiber was developed and commercialized a long time ago by distinguished companies such as DuPont in the USA or KOLON in Korea, the heat resistant spun yarn and the heat resistant fabric having both intrinsic characteristics of the heat resistant fiber and elasticity have not been developed yet.

In the aforementioned Examples described with reference to FIGS. 1 to 11, the heat resistant spun yarn having improved elasticity as compared to a known heat resistant spun yarn is manufactured using the single yarn formed of the single heat resistant fiber. However, the scope of the present invention is not limited thereto. For example, the aforementioned Examples may be identically or similarly applied to manufacture a spun yarn using a heat resistant blend fiber single yarn including the heat resistant fiber.

Figure 12:
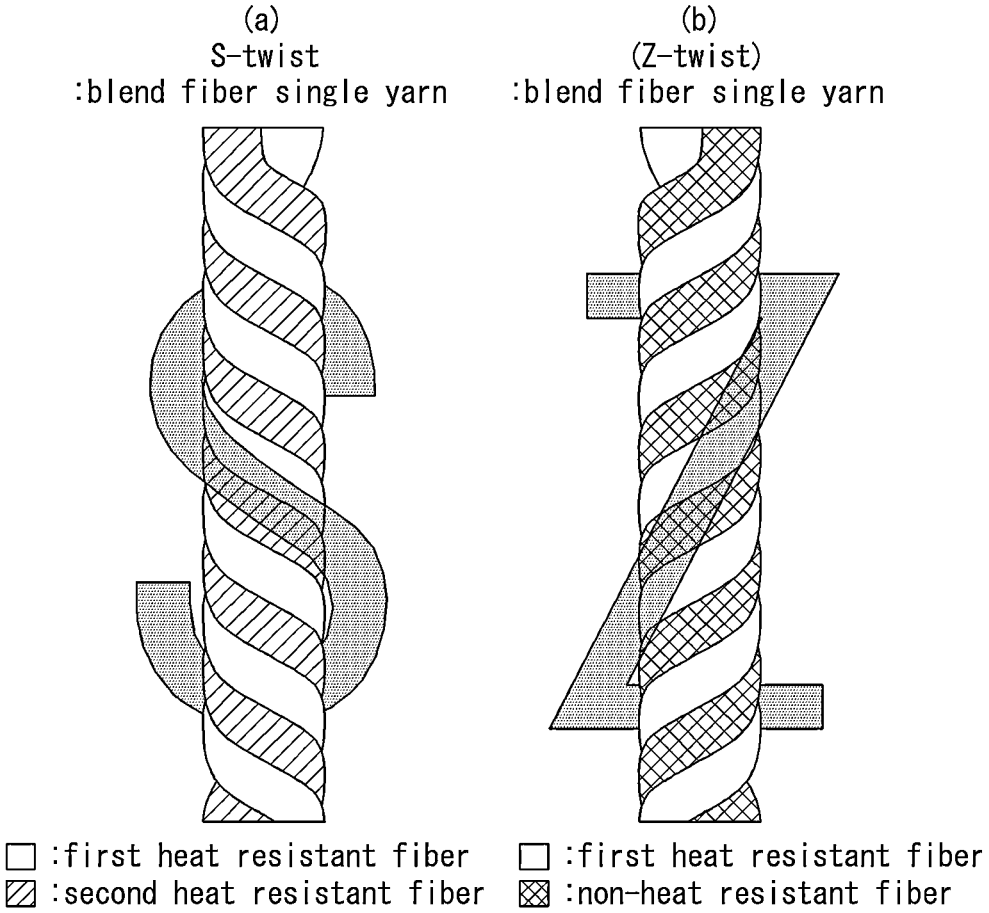
FIG. 12 shows examples of heat resistant blend fiber single yarns manufactured according to the method for manufacturing the spun yarn according to the present invention.

FIG. 12 shows examples of heat resistant blend fiber single yarns manufactured according to the method for manufacturing the spun yarn according to the present invention.

Referring to FIG. 12(*a*), the blend heat resistant fiber may be formed by blending a first heat resistant fiber and a second heat resistant fiber. It is preferable that a blending ratio of the first heat resistant fiber and the second heat resistant fiber be appropriately adjusted according to the use purpose.

The first heat resistant fiber may be an aramid fiber, and the second heat resistant fiber may be a heat resistant fiber other than the aramid fiber. Meanwhile, FIG. 12(*a*) shows the heat resistant fiber where two types of heat resistant fibers are blended as an example, but is just an embodiment of the present invention. The aforementioned heat resistant blend fiber may be a heat resistant blend fiber where three types or more of heat resistant fibers are blended.

Referring to FIG. 12(*b*), the blend heat resistant fiber may be formed by blending the first heat resistant fiber and a non-heat resistant fiber. It is preferable that a blending ratio of the first heat resistant fiber and the non-heat resistant fiber be appropriately adjusted according to the use purpose.

Herein, the non-heat resistant fiber may be a flame retardant fiber or a flammable fiber other than the fiber typically classified as the heat resistant fiber. Meanwhile, FIG. 12(*b*) shows the heat resistant fiber where a type of heat resistant fiber and a type of non-heat resistant fiber are blended as an example, but the scope of the present invention is not limited thereto. For example, two types or more of heat resistant fibers may be blended or two types or more of non-heat resistant blend fibers may be blended in the blend fiber.

In the aforementioned Examples described with reference to FIGS. 1 to 11, the heat resistant spun yarn having improved elasticity as compared to a known heat resistant spun yarn is manufactured by combining the yarns using the same type of heat resistant single yarn. However, the scope of the present invention is not limited thereto. For example, the aforementioned Examples may be identically or similarly applied to manufacture the spun yarn by combining different types of heat resistant fiber single yarns or combining the heat resistant fiber single yarn and the non-heat resistant fiber single yarn.

Figure 13:
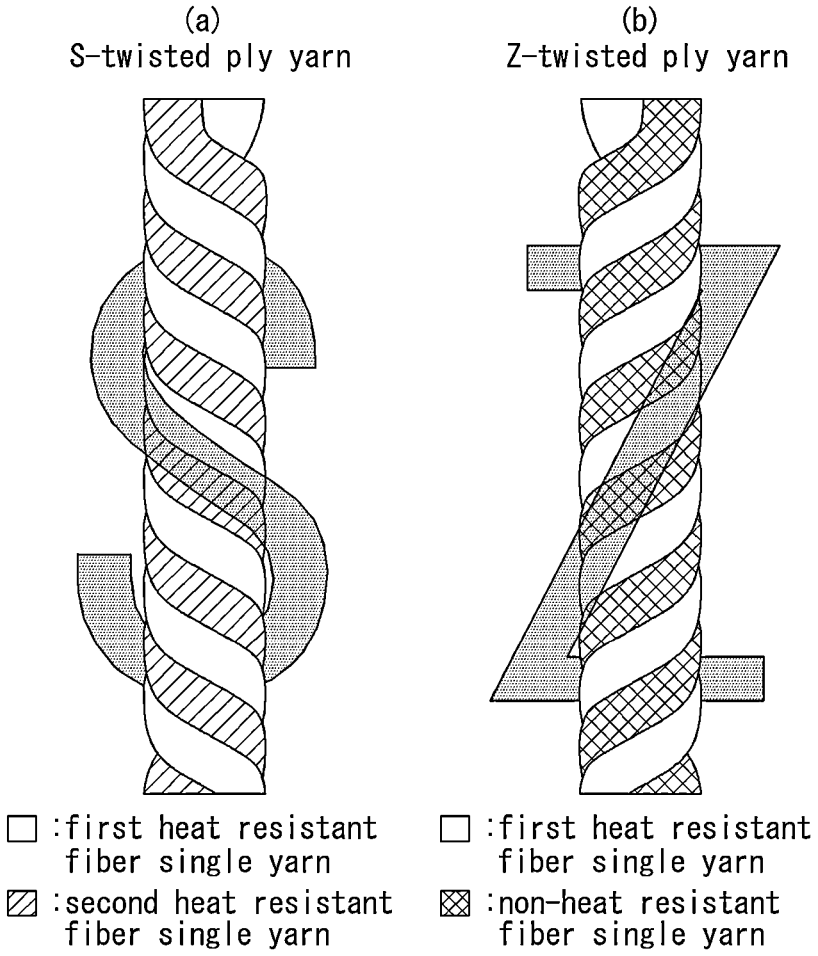
FIG. 13 shows various types of heat resistant fiber ply yarns manufactured according to the method for manufacturing the spun yarn according to the present invention.

FIG. 13 shows various types of heat resistant fiber ply yarns manufactured according to the method for manufacturing the spun yarn according to the present invention.

Referring to FIG. 13(*a*), it can be seen that the heat resistant fiber ply yarn manufactured according to the method for manufacturing the spun yarn according to the present invention may be manufactured by combining and twisting a first heat resistant fiber single yarn and a second heat resistant fiber single yarn. However, the scope of the present invention is not limited thereto. For example, the heat resistant fiber ply yarn used in the method for manufacturing the spun yarn according to the present invention may be manufactured by combining and twisting three types or more of different heat resistant fiber single yarns.

Referring to FIG. 13(*b*), it can be seen that the heat resistant fiber ply yarn manufactured according to the method for manufacturing the spun yarn according to the present invention may be manufactured by combining and twisting the first heat resistant fiber single yarn and a non-heat resistant fiber single yarn. However, the scope of the present invention is not limited thereto. For example, the heat resistant fiber ply yarn may be manufactured to include two types or more of heat resistant fiber single yarns and two types or more of non-heat resistant fiber single yarns.

Figure 14:
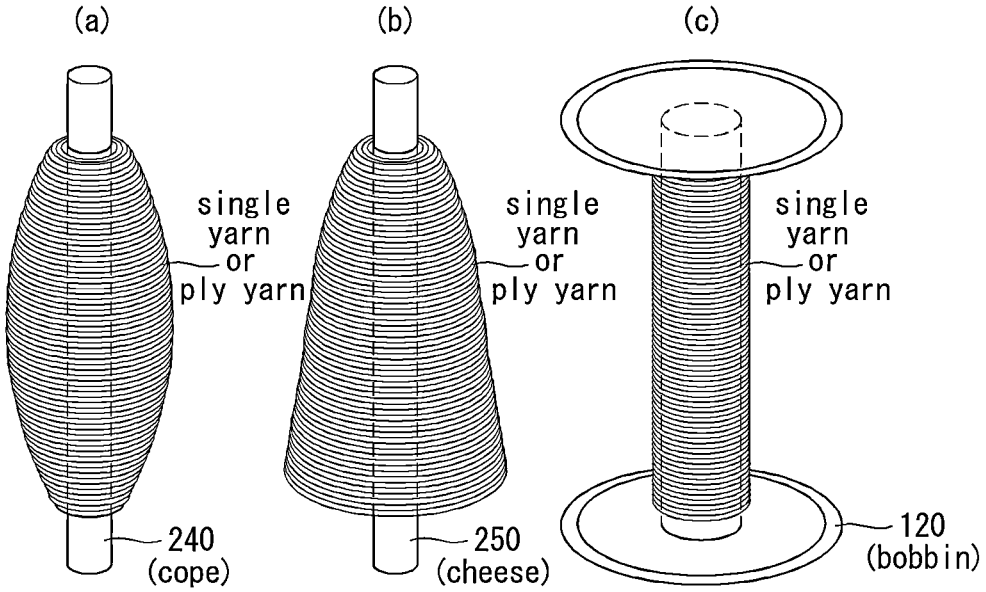
FIG. 14 shows examples of the types provided to the heat setting process in the method for manufacturing the spun yarn according to the present invention.

FIG. 14 shows examples of the types provided to the heat setting process in the method for manufacturing the spun yarn according to the present invention.

Referring to FIG. 14(*a*), it can be seen that the manufactured single yarn or ply yarn may be provided to a device of providing heat for heat setting while being wound around a cope 240 during the spun yarn manufacturing process.

Referring to FIG. 14(*b*), it can be seen that the manufactured single yarn or ply yarn may be provided to the device of providing heat for heat setting while being wound around a cheese 250 during the spun yarn manufacturing process.

Referring to FIG. 14(*c*), it can be seen that the manufactured single yarn or ply yarn may be provided to the device of providing heat for heat setting while being wound around a bobbin 120 during the spun yarn manufacturing process.

Figure 15:
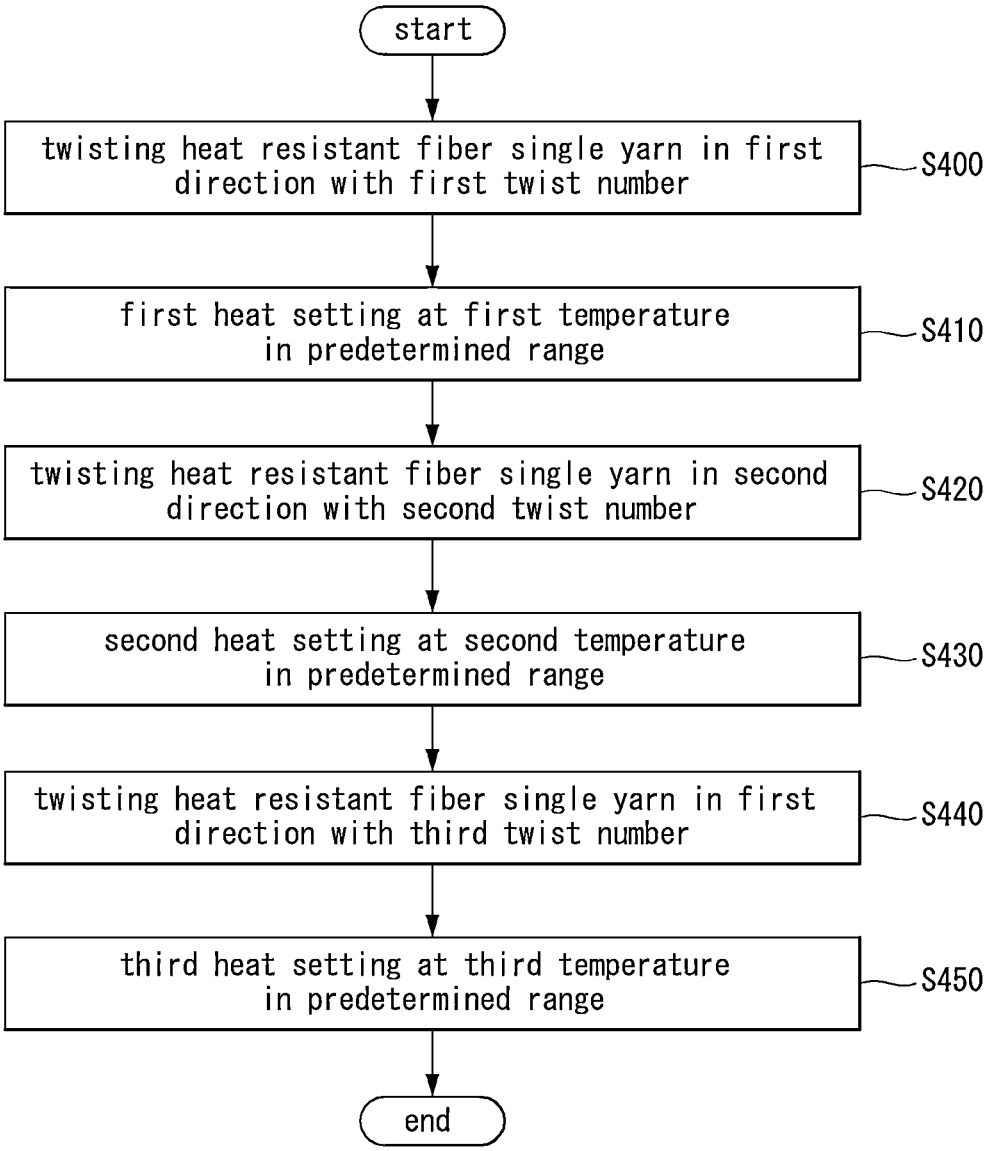
FIG. 15 is a flowchart showing a method for manufacturing a heat resistant spun yarn according to another embodiment of the present invention.

FIG. 15 is a flowchart showing a method for manufacturing a heat resistant spun yarn according to another embodiment of the present invention. For reference, the method for manufacturing the heat resistant spun yarn is a method for manufacturing a spun yarn having elasticity by the single yarn instead of the ply yarn.

First, a heat resistant fiber single yarn is twisted in a first direction with a first twist number S400. The heat resistant fiber single yarn may be a type of heat resistant fiber single yarn, a blend fiber including two types or more of heat resistant fibers, or a blend fiber including a non-heat resistant fiber in addition to the heat resistant fiber. Next, a first heat setting process of the single yarn is performed at a first temperature in a predetermined range S410.

The single yarn subjected to first heat setting treatment is twisted in a second direction that is contrary to the first direction with a second twist number S420. Next, a second heat setting process of the single yarn is performed at a second temperature in a predetermined range S430. Meanwhile, it is preferable that the first temperature be higher than the second temperature. This is because it is easy to provide elasticity only when a property of returning back to a state after first heat setting is superior to a property of maintaining a state after second heat setting treatment.

Next, the single yarn subjected to the second heat setting treatment is twisted in the first direction with a third twist number S440. The twisting process is performed to provide again the property of returning back to the state after the first heat setting treatment, and may be a process of improving provision of elasticity. Meanwhile, the second twist number may be larger than a sum total of the first twist number and the third twist number.

Next, a third heat setting process of the single yarn is performed at a third temperature in a predetermined range S450. Herein, the third temperature may be lower than the first temperature and the second temperature. Meanwhile, all of the first to third temperatures may be a temperature of 50 to 100° C.

Unlike FIG. 15, the first to third heat setting processes may be an optional process. For example, according to another embodiment of the present invention, only any one of the first to third heat setting processes may be performed, or only two heat setting processes may be performed.

Further, unlike FIG. 15, the twisting process S440 performed after the second heat setting process may be an optional process.

Figure 16:
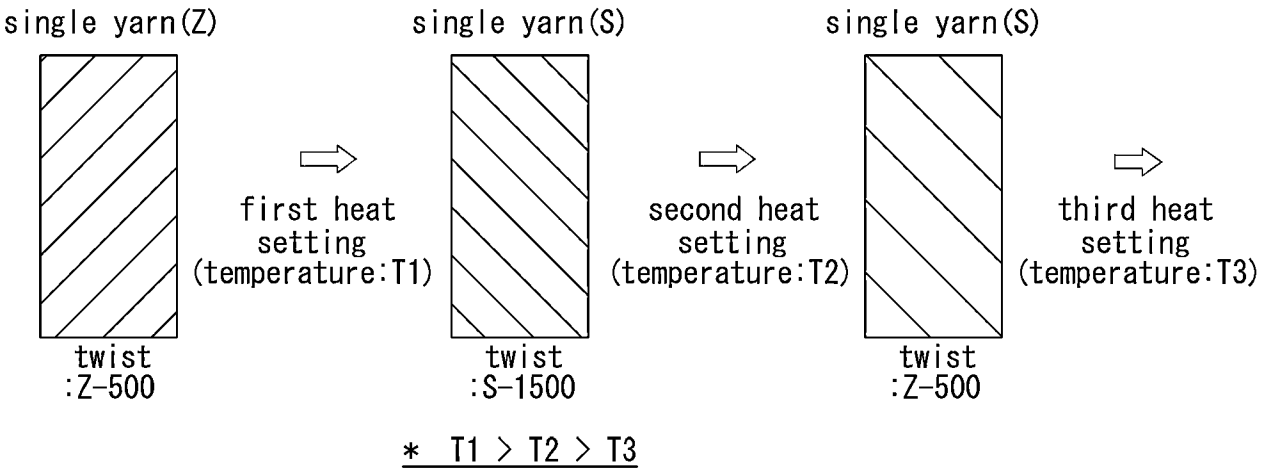
FIG. 16 is a view showing an example of a process of manufacturing a heat resistant single yarn according to the method for manufacturing the heat resistant spun yarn shown in FIG. 15.

FIG. 16 is a view showing an example of a process of manufacturing a heat resistant single yarn according to the method for manufacturing the heat resistant spun yarn shown in FIG. 15.

After the heat resistant single yarn is twisted in a z-direction with a twist number of 500, the heat setting process is performed at a first temperature T1. Next, after the heat resistant single yarn is twisted in an s-direction with a twist number of 1500, the second heat setting process is performed at a second temperature T2. Next, after the heat resistant single yarn is twisted in the z-direction with a twist number of 500, the third heat setting process is performed at a third temperature T3. That is, a final twist type of the heat resistant single yarn manufactured according to the method for manufacturing the heat resistant spun yarn is an s-direction twist number of 500.

FIG. 17 is a test report of the heat resistant fabrics manufactured according to the present invention. FIG. 18 shows enlargement of only elongation test results of the test report shown in FIG. 17. For reference, the test institute is Korea Apparel Testing & Research Institute (KATRI).

In the test, sample 1 is heat resistant fabrics manufactured by applying the present invention to a blended fiber of a PBO-based heat resistant fiber and a para-based heat resistant fiber at a ratio of 40:60. Sample 2 is typical heat resistant fabrics manufactured by using the blended fiber of the PBO-based heat resistant fiber and the para-based heat resistant fiber. In the test, sample 3 is heat resistant fabrics manufactured by applying the present invention to a metha-based heat resistant fiber. Sample 4 is typical heat resistant fabrics manufactured by using the metha-based heat resistant fiber.

Referring to FIGS. 17 and 18, elongations of the heat resistant fabrics to which the present invention is applied are 8.5% and 7.9%. Elongations of the typical heat resistant fabrics as a comparison target are 1.8% and 1.7%. That is, referring to the test report, it can be seen that the heat resistant fabrics manufactured according to the present invention have significantly improved elongation as compared to the typical heat resistant fabrics.

Figure 19:
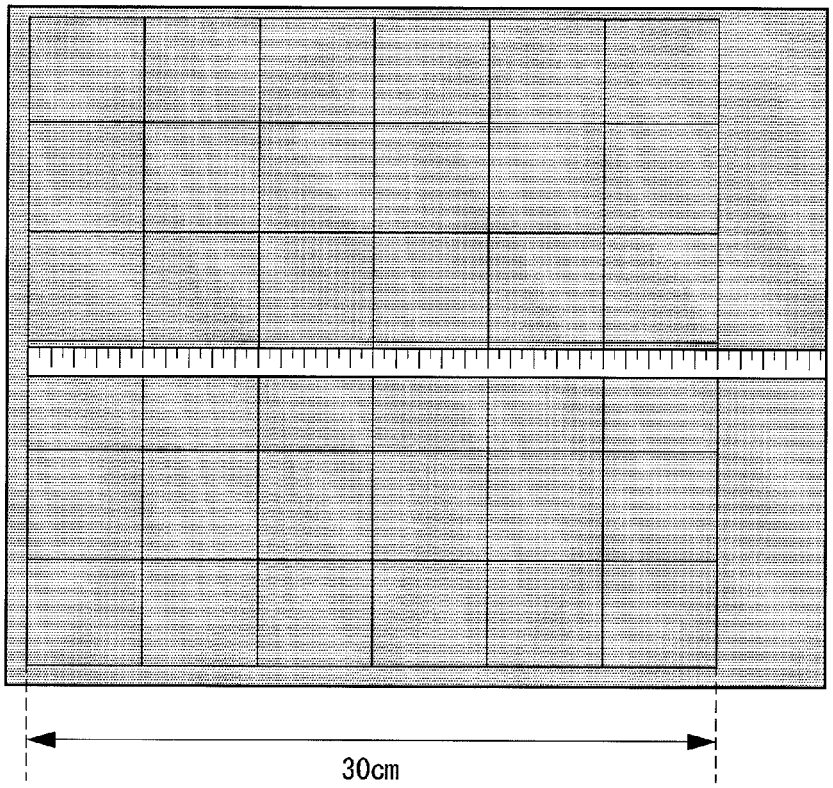
FIGS. 19 and 20 are views showing a process of expressing actual elongation of sample 1 subjected to the test of FIG. 17.
Figure 20:
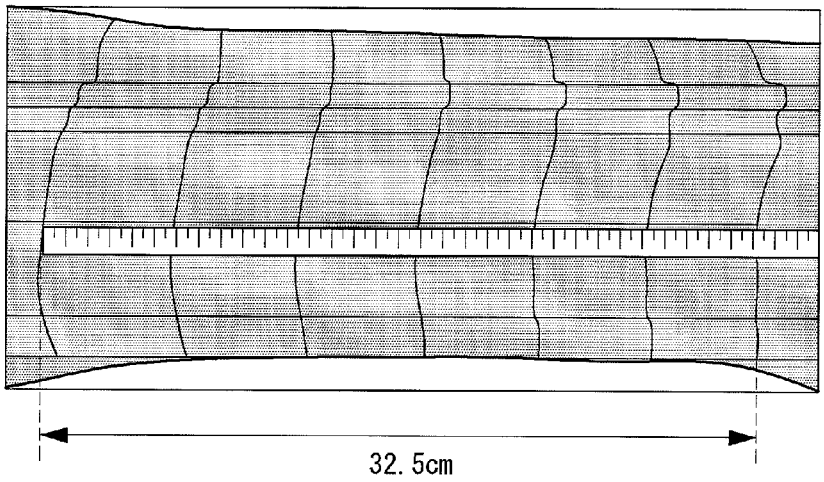

FIGS. 19 and 20 are views showing a process of expressing actual elongation of sample 1 subjected to the test of FIG. 17. In more detail, FIG. 19 shows a state before sample 1 is drawn in a direction of right and left. FIG. 20 shows a state where both ends of sample 1 are drawn by hands.

Referring to FIGS. 19 and 20, it can be seen that when both ends of sample 1 are drawn by user's hands, a length of sample 1 is increased from 30 cm to 32.5 cm. That is, even if sample 1 is simply drawn by hands, sample 1 has elongation of about 8.3%. Meanwhile, when a user removes force applied to sample 1, the length of sample 1 is restored back to 30 cm.

Figure 21:
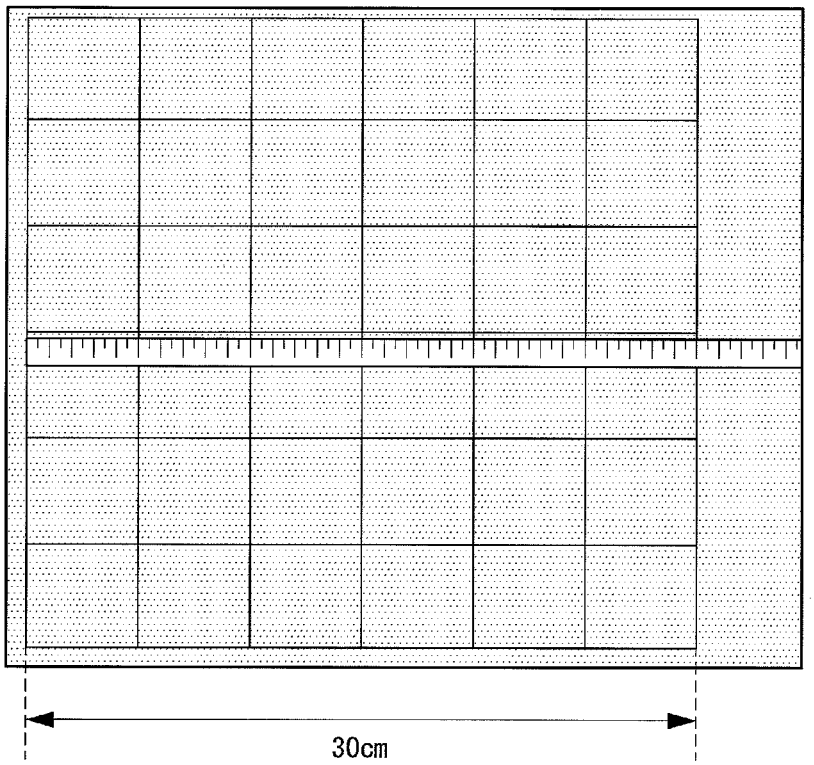
FIGS. 21 and 22 are views showing a process of expressing actual elongation of sample 3 subjected to the test of FIG. 17.
Figure 22:
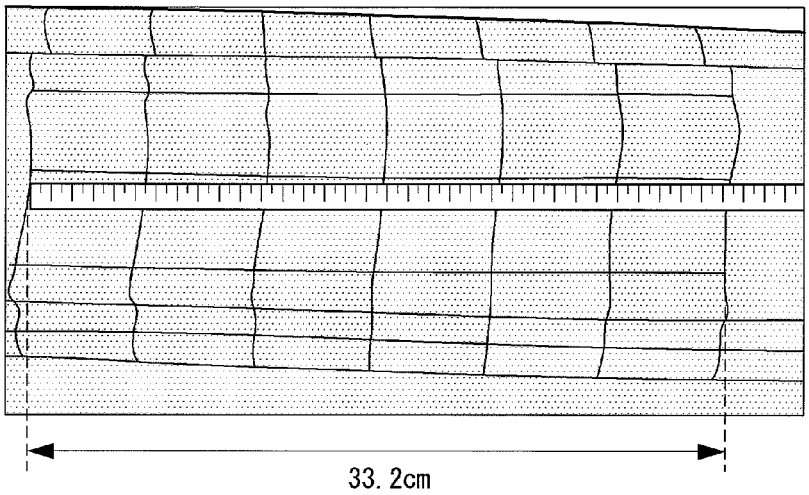

FIGS. 21 and 22 are views showing a process of expressing actual elongation of sample 3 subjected to the test of FIG. 17. In more detail, FIG. 21 shows a state before sample 3 is drawn in a direction of right and left. FIG. 22 shows a state where both ends of sample 3 are drawn by hands.

Referring to FIGS. 21 and 22, it can be seen that when both ends of sample 3 are drawn by the user's hands, the length of sample 3 is increased from 30 cm to 33.2 cm. That is, even if sample 3 is simply drawn by the hands, sample 3 has elongation of 10.2%. Meanwhile, when the user removes force applied to sample 3, the length of sample 3 is restored back to 30 cm.

Although the present invention has been described in connection with the limiting exemplary embodiments and the drawings, but the present invention is not limited thereto, and it will be apparent to those skilled in the art that various modifications and changes may be made thereto without departing from the scope and spirit of the invention.

Therefore, the scope of the present invention is defined by the appended claims rather than by the description preceding them, and all changes and modifications that fall within metes and bounds of the claims, or equivalents of such metes and bounds are therefore intended to be embraced by the claims.

| [Description of Reference Numerals] | |
|---|---|
| 100: chamber | 110: shelf |
| 120: bobbin | 130: single yarn |
| 140: z-twist single yarn | 150: s-twist single yarn |
| 160: first roller | 170: second roller |
| 180: water tank | |
| 190: heat resistant fabric | |
| 200: water tank | |
| 210: heat resistant fabric | |
| 220: high density fabric | |

What is claimed is:

1. A method for manufacturing a heat resistant spun yarn having improved elasticity, comprising:

a single yarn manufacturing process of twisting a heat resistant fiber in a first direction with a twist number in a predetermined range;

a first heat setting process of applying heat at a first temperature in a predetermined range to a single yarn manufactured according to the single yarn manufacturing process;

a ply yarn manufacturing process of combining at least two single yarns subjected to the first heat setting process and twisting the single yarns in the first direction with a first twist number in a predetermined range;

a second heat setting process of applying heat at a second temperature in a predetermined range to a ply yarn manufactured according to the ply yarn manufacturing process;

a reverse twisting process of twisting the ply yarn subjected to the second heat setting process in a second direction that is contrary to the first direction with a second twist number in a predetermined range;

a third heat setting process of applying heat at a third temperature in a predetermined range to the ply yarn subjected to the reverse twisting process; and a re-twisting process of twisting the ply yarn subjected to the third heat setting process in the first direction with a third twist number in a predetermined range, wherein the second twist number is larger than a sum total of the first twist number and the third twist number, wherein the second temperature is higher than the first temperature, wherein the first temperature is higher than the third temperature, wherein the second temperature is more than 50° C. and 100° C. or less, and wherein the third temperature is 50° C. or more and less than 100° C.

2. The method of claim 1, wherein time of the second heat setting time is longer than the time of the first heat setting and the time of the third heat setting.

3. The method of claim 1, wherein the heat resistant fiber is a blend fiber including a first heat resistant fiber and a second heat resistant fiber.

4. The method of claim 1, wherein the heat resistant fiber is a blend fiber including a heat resistant fiber and a non-heat resistant fiber.

5. The method of claim 1, wherein the first temperature is higher than the third temperature.

6. The method of claim 1, wherein an additional heat setting process is not performed after the re-twisting process.

7. The method of claim 1, wherein the heat resistant spun yarn comprises at least one heat resistant fiber selected from the group consisting of a para-based polyamide fiber, a meta-based polyamide fiber, an aromatic polyester fiber and a polyparaphenylene-benzobisoxazole fiber.

* * * * *